US007828582B2

(12) United States Patent
Xu et al.

(10) Patent No.: US 7,828,582 B2
(45) Date of Patent: Nov. 9, 2010

(54) ELECTRICAL CONNECTOR HAVING MOVEABLE METAL LATCH

(75) Inventors: Bin Xu, Kunshan (CN); Su-Feng Liu, Kunshan (CN); Chin-Te Lai, Tu-Cheng (TW); Jun Zong, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/684,988

(22) Filed: Jan. 11, 2010

(65) Prior Publication Data

US 2010/0184320 A1 Jul. 22, 2010

(30) Foreign Application Priority Data

Jan. 18, 2009 (CN) ..... 2009 2 0300285

(51) Int. Cl.
*H01R 13/627* (2006.01)

(52) U.S. Cl. ..... 439/353

(58) Field of Classification Search ..... 439/350, 439/352, 353

See application file for complete search history.

(56) References Cited

U.S. PATENT DOCUMENTS

| | | | | |
|---|---|---|---|---|
| 4,526,431 | A * | 7/1985 | Kasukawa | 439/353 |
| D412,700 | S | 8/1999 | Gardner et al. | |
| 7,695,304 | B2 * | 4/2010 | Chiang et al. | 439/353 |
| 2008/0200058 | A1 * | 8/2008 | Tsai | 439/353 |

* cited by examiner

*Primary Examiner*—Tho D Ta
(74) *Attorney, Agent, or Firm*—Wei Te Chung; Andrew C. Cheng; Ming Chieh Chang

(57) ABSTRACT

An electrical connector (100) for mating with a mating connector (800) along a mating direction includes an insulative housing (1), a pair of latches (7) and a number of terminals (5) received in the insulative housing. The insulative housing has a front face (11), a pair of side walls (13) each defining an opening (131), a pair of receiving spaces (12, 14) defined between the pair of side walls, and a partition (16) disposed between the pair of receiving spaces. The pair of latches are mounted in the openings and each formed with an engaging portion (75). The latch resiliently yields in the opening along a moving direction perpendicular to the mating direction to permit the engaging portion moveable between a locked position and an unlocked position.

14 Claims, 7 Drawing Sheets

ELECTRICAL CONNECTOR HAVING MOVEABLE METAL LATCH

BACKGROUND OF THE INVENTION

1. Field of the Invention

The present invention relates to an electrical connector, and more particularly to a connector made according SATA (Serial Advanced Technology Attachment) protocol in which a metal latch is incorporated to securely interconnect with a mating connector.

2. Description of Related Art

A connector is described in U.S. Pat. No. Des. 412,700 issued to Gardner on Aug. 10, 1999 and entitled "Combined Signal and Power Connector". The connector comprises an insulative housing having a base portion and a mating portion projecting from the base portion. The mating portion has a pair of receiving spaces and a partition wall disposed between the pair of receiving spaces. The base wall has a pair of guiding projections formed at opposite ends. The pair of guiding projections are made from insulative material and engageable with a pair of holes defined on the mating connector.

The engagement between the guiding projections and the holes defined in the mating connector are merely via physical interference and are not so reliable as it may result in undesirable disengagement of the mating connector away from the SATA connector.

Hence, an electrical connector having moveable metal latch is highly desired.

SUMMARY OF THE INVENTION

Accordingly, an object of the present invention is to provide an electrical connector mating with a mating connector reliably due to a resilient movement of a pair of metal latches.

To achieve the above object, an electrical connector for mating with a mating connector along a mating direction includes an insulative housing, a pair of latches and a plurality of terminals received in the insulative housing. The insulative housing has a front face, a pair of side walls each defining an opening, a pair of receiving spaces defined between the pair of side walls, and a partition disposed between the pair of receiving spaces. The pair of latches are mounted in the openings and each formed with an engaging portion. The latch resiliently yields in the opening along a moving direction perpendicular to the mating direction to permit the engaging portion moveable between a locked position and an unlocked position.

The engagement between the mating connector and the electrical connector is secured due to the resilient movement of the metal latches.

Other objects, advantages and novel features of the invention will become more apparent from the following detailed description when taken in conjunction with the accompanying drawings.

DETAILED DESCRIPTION OF THE PREFERRED EMBODIMENT

Figure 1:
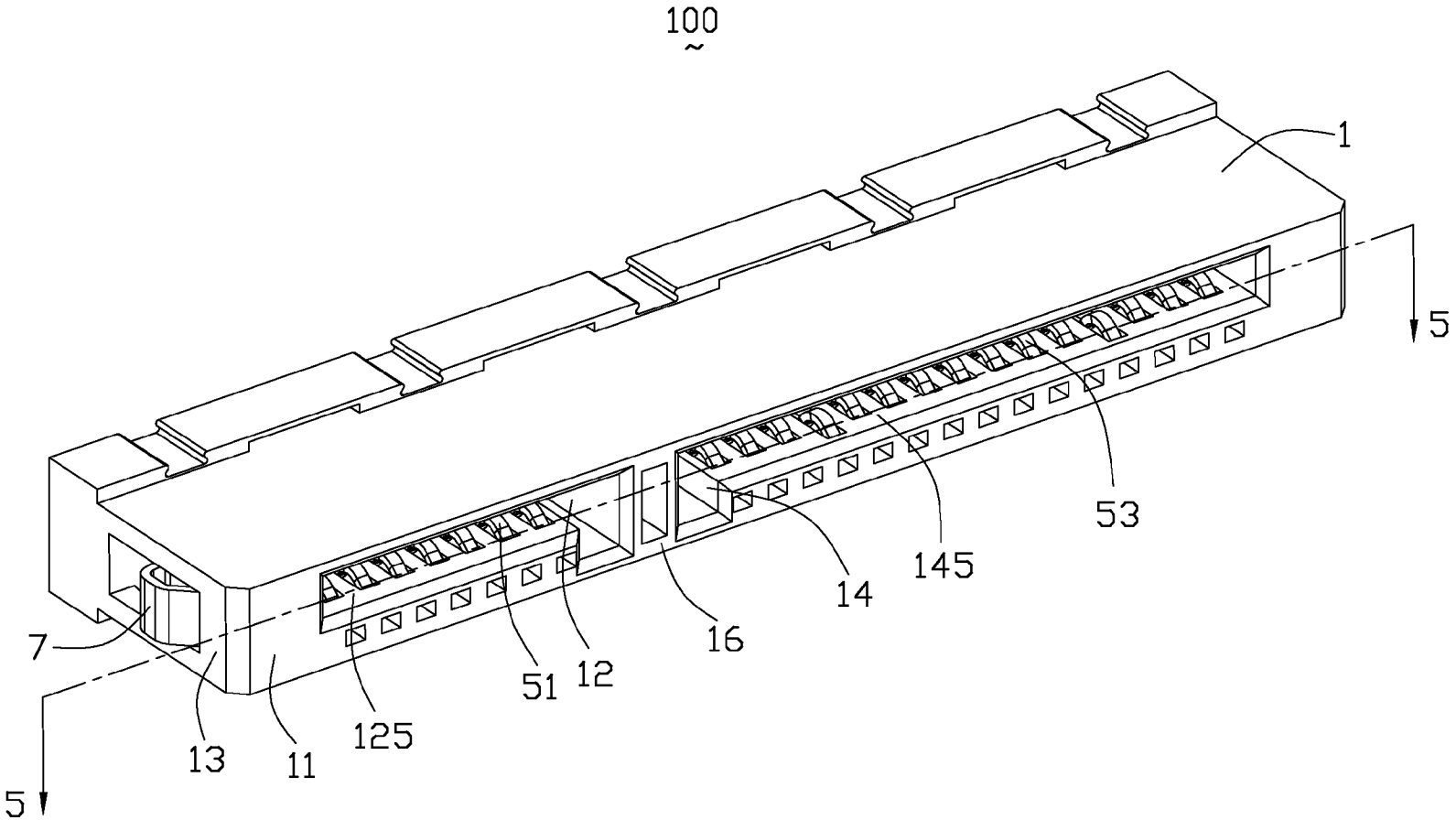
FIG. 1 is a perspective view of an electrical connector in accordance with the present invention.

Reference will now be made to the drawing figures to describe the present invention in detail. Referring to FIGS. 1-7, an electrical connector 100 in accordance with a preferred embodiment of the present invention is adapted for mating with a mating connector 800 along a mating direction. The electrical connector 100 comprises an insulative housing 1, an organizer 3 mounted on the insulative housing 1, a plurality of terminals 5 received in the insulative housing 1, and a pair of metal latches 7 mounted on opposite ends of the insulative housing 1. The mating connector 800 is formed with a conductive pad 81 and a concave portion 82 disposed in sequence along the mating direction.

Referring to FIGS. 1-4, the insulative housing 1 has a front face 11 and a rear face 15 opposite to the front face 11. The insulative housing 1 comprises a pair of side walls 13, a partition 16 and a receiving cavity. The receiving cavity is divided into a first receiving cavity 12 and a second receiving cavity 14 by the partition 16. The rear face 15 defines a passage 151 between the pair of side walls 13 and located behind the first and second receiving cavities 12, 14. The insulative housing 1 has a first supporting wall 125 formed in the first receiving cavity 12 and a second supporting wall 145 formed in the second receiving cavity 14. In conjunction with FIG. 5, the first supporting wall 125 defines a plurality of first passageways 127 exposed in the first receiving cavity 12 and a plurality of second passageways 147 exposed in the second receiving cavity 14.

Figure 4:
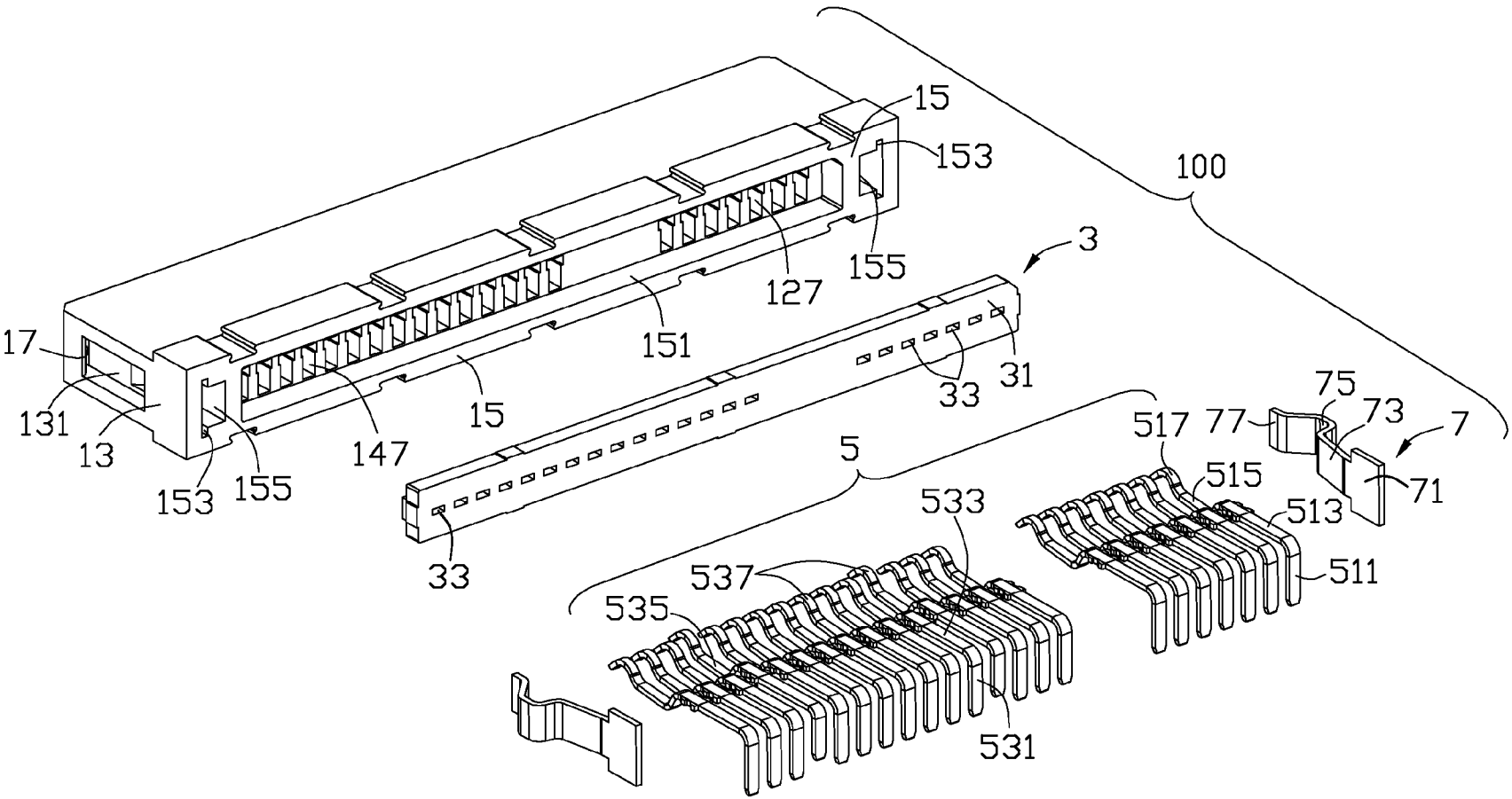
FIG. 4 is an exploded view similar to FIG. 2, taken from another aspect.
Figure 5:
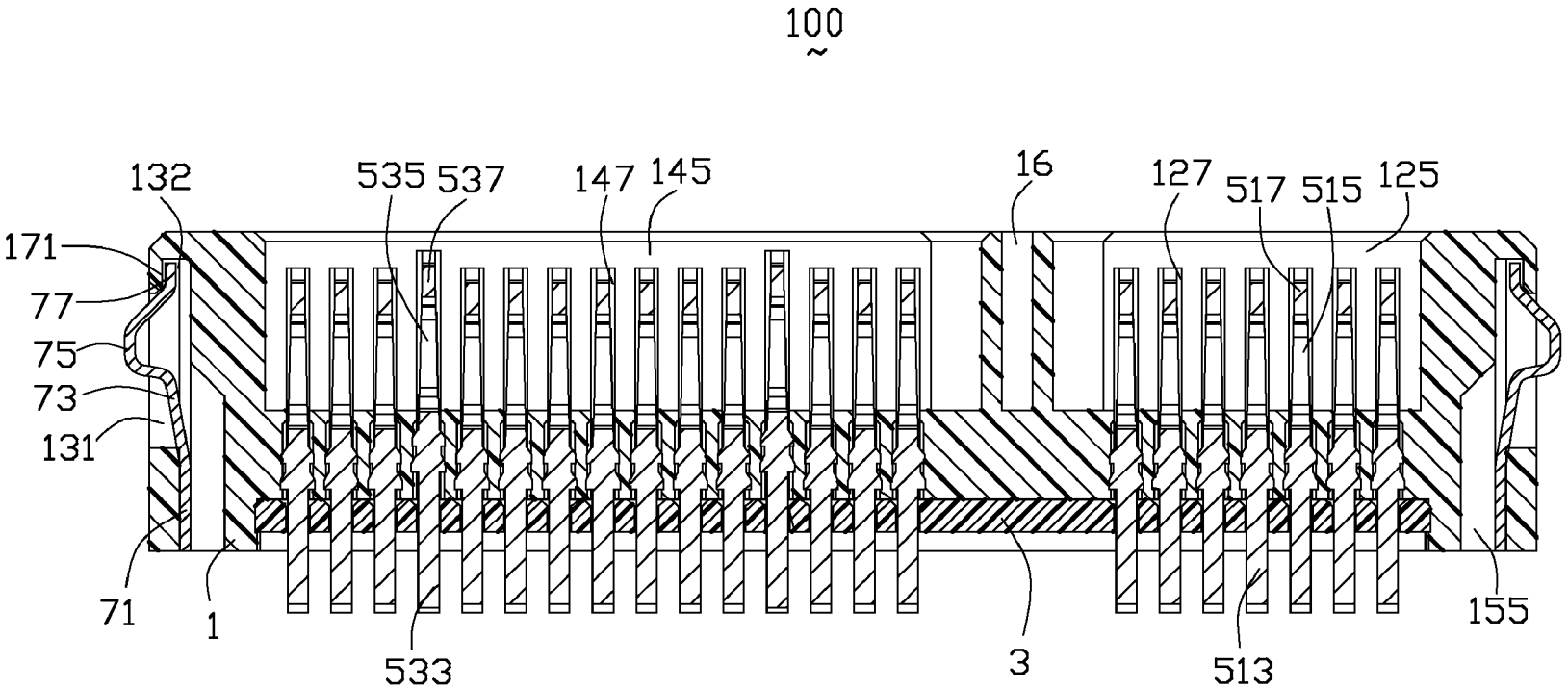
FIG. 5 is a cross-sectional view of the electrical connector as shown in FIG. 1, taken along line 5-5.

Referring to FIGS. 4 and 5, each side wall 13 defines an opening 131 exposed outwardly, a slot 153 in communicating with the opening 131, a recess 132 opposite to the slot 153, a groove 155 communicating with the opening 131 and adjacent to the slot 153. The slot 153 has a height larger than that of the groove 155. In conjunction with FIGS. 6 and 7, the side wall 13 is formed with a bearing face 171 facing toward the recess 132 and an inner face 133 opposite to the bearing face 171.

Each metal latch 7 comprises a fixing portion 71, an arcuate engaging/locking portion 75, a resilient portion 73 formed between the fixing portion 71 and the engaging portion 75, and a resisting portion 77 formed at a free end of the engaging portion 75. The fixing portion 71 has a height greater than that of the engaging portion 75, resilient portion 73 or the resisting portion 77.

Figure 2:
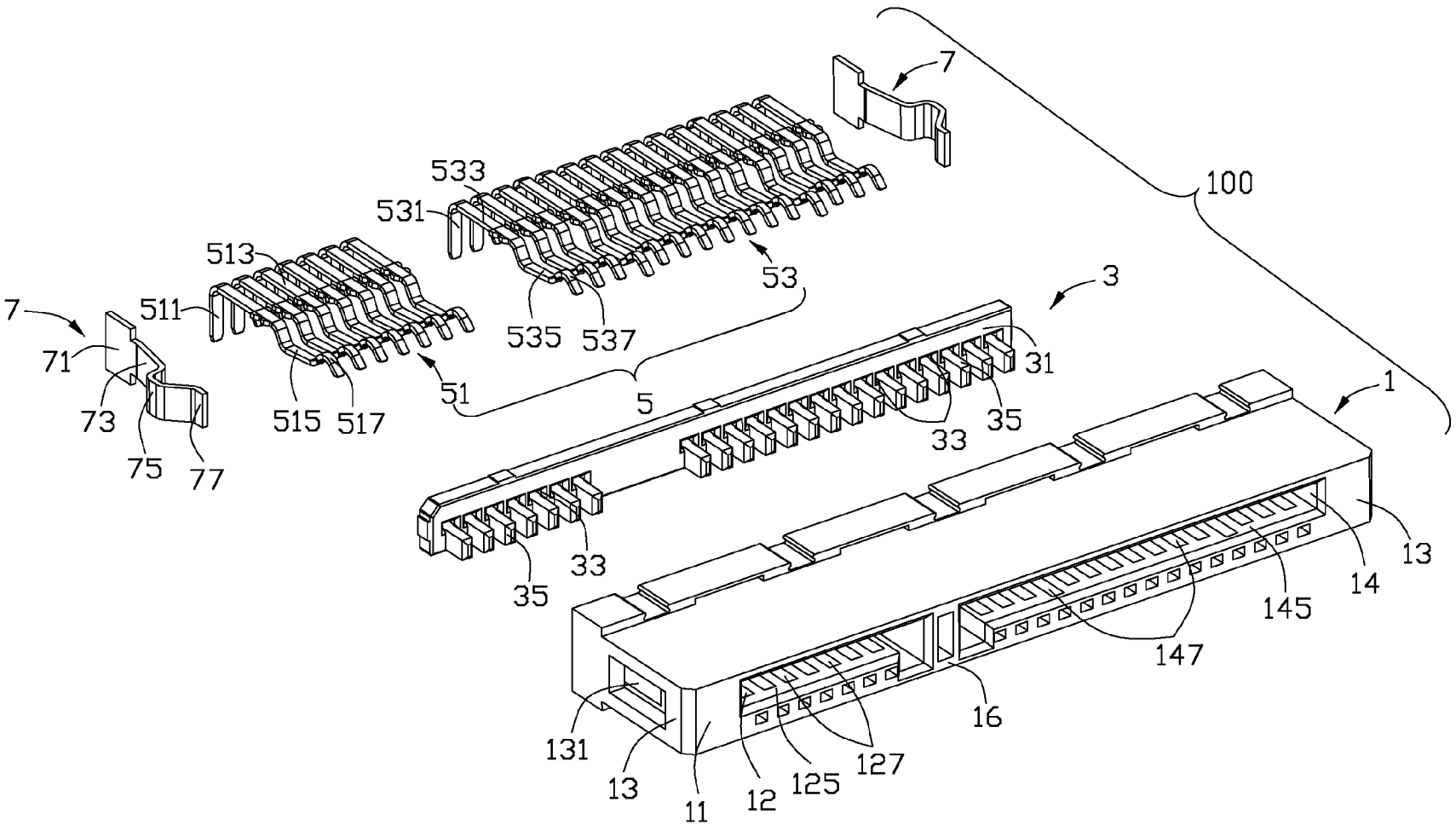
FIG. 2 is an exploded perspective view of the electrical connector as shown in FIG. 1.
Figure 3:
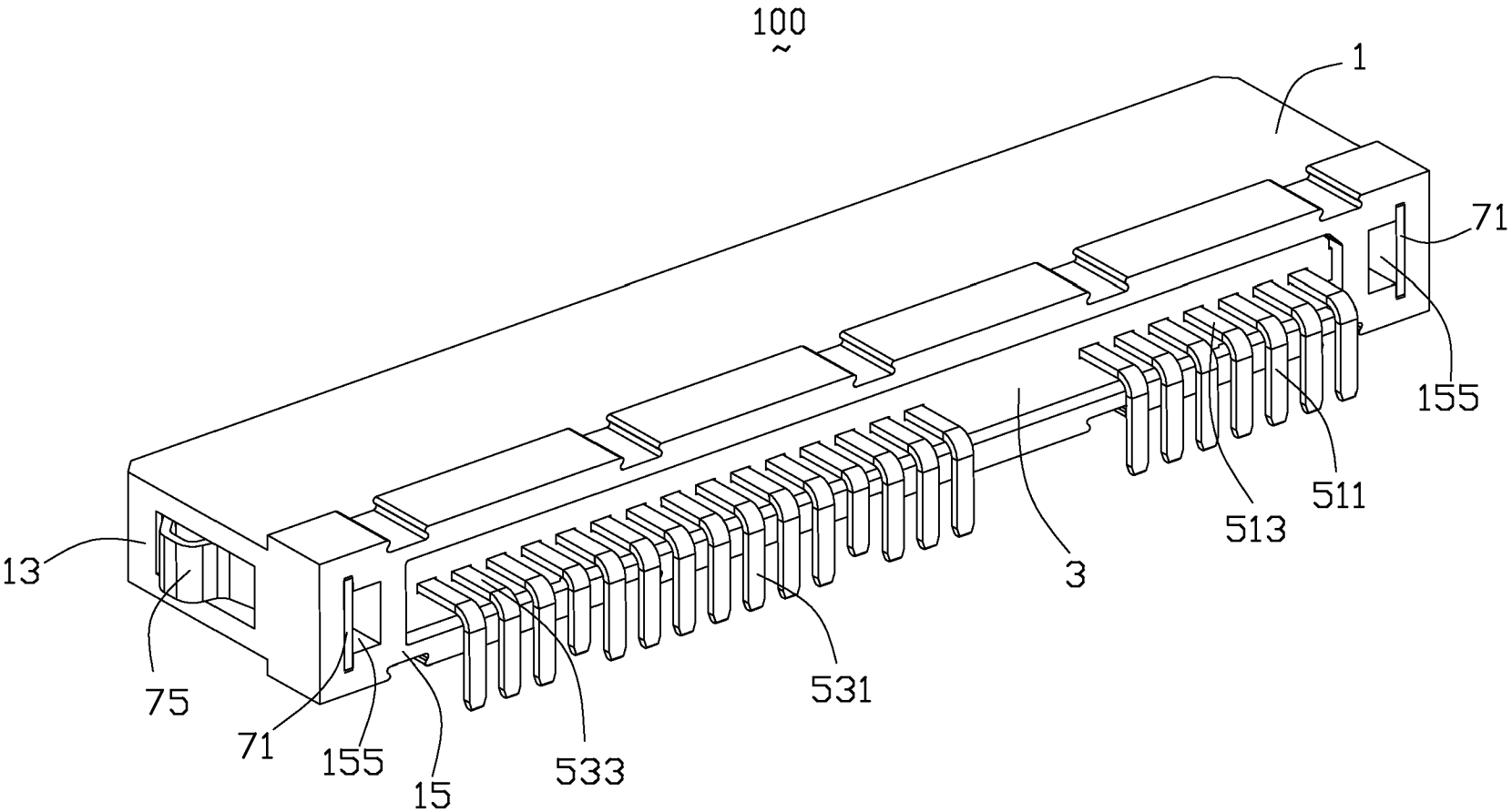
FIG. 3 is another perspective view of the electrical connector as shown in FIG. 1.

Referring to FIGS. 2 and 4, the organizer 3 has a base 31, a plurality of terminal recesses 33 defined in the base 31, a plurality of blocks 35 projecting forwardly from the base 31 and below corresponding terminal recesses 33.

Referring to FIGS. 2, 4 and 5, the terminals 5 comprise a plurality of first terminals 51 received in the first passageways 127 and a plurality of second terminals 53 received in the second passageways 147. Each first terminal 51 has a first soldering end 511 adapted for soldering on a printed circuit board (not shown), a first supporting portion 513 perpendicular to the first soldering end 511, a first neck portion 515 parallel to the first supporting portion 513, and a first contact end 517 bending from the first neck portion 515. Each second terminal 53 has a second soldering end 531 adapted for soldering on the printed circuit board, a second supporting portion 533 perpendicular to the second soldering end 531, a second neck portion 535 parallel to the second supporting portion 533, and a second contact end 537 bending from the second neck portion 535.

Referring to FIG. 5, in assembly of the electrical connector 100, the first and second terminals 51 and 53 are inserted into the terminal recesses 33 of the carrier 3, with the first and second supporting portions 513, 533 partially supported by the blocks 35. The first and second terminals 51 and 53 are inserted into the first and second passageways 127, 147. The carrier 3 is mounted in the passage 151. The first and second contact ends 517 and 537 of the first and second terminals 51, 53 are exposed to the first and second receiving cavities 12 and 14, respectively. The metal latches 7 are respectively mounted at opposite openings 131. The engaging portion 75 together with the resilient portion 73 and the resisting portion 77 are inserted into the opening 131 through the groove 155. The fixing portion 71 is secured to the slot 153. The engaging portion 75 projects outwardly from the side wall 13 through the opening 131. The resisting portion 77 resists against the bearing face 171 of the side wall 13. The metal latch 7 is secured to a locked position. The resilient portion 73, together with the engaging portion 75 and the resisting portion 77 are resiliently moveable in the opening 131 and the recess 132 along a moving direction perpendicular to the mating direction.

Figure 6:
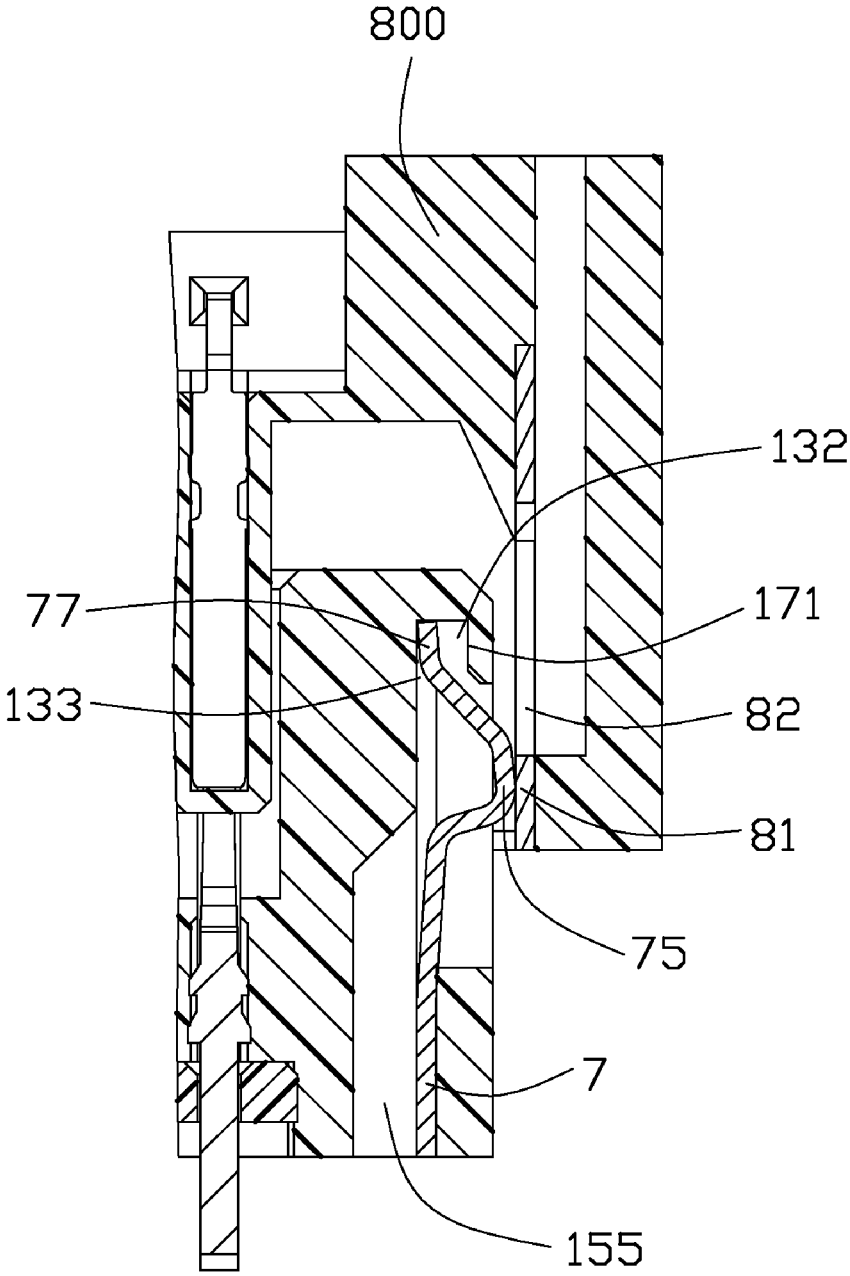
FIG. 6 is a partially cross-sectional view of the electrical connector and the mating connector at an unlocked position.

Referring to FIG. 6, when a mating connector 800 is mating with the electrical connector 100 along the mating direction, the engaging portion 75 of metal latch 7 is depressed inwardly by the mating connector 800. The resilient portion 73 resiliently yields inwardly along the moving direction and the resisting portion 77 moves away from the bearing face 171 toward the inner face 133. When the resisting portion 77 arriving at or adjacent to the inner face 133, the engaging portion 75 come to contact with the conductive pad 81 of the mating connector 800. The metal latch 7 arrives at an unlocked position.

Figure 7:
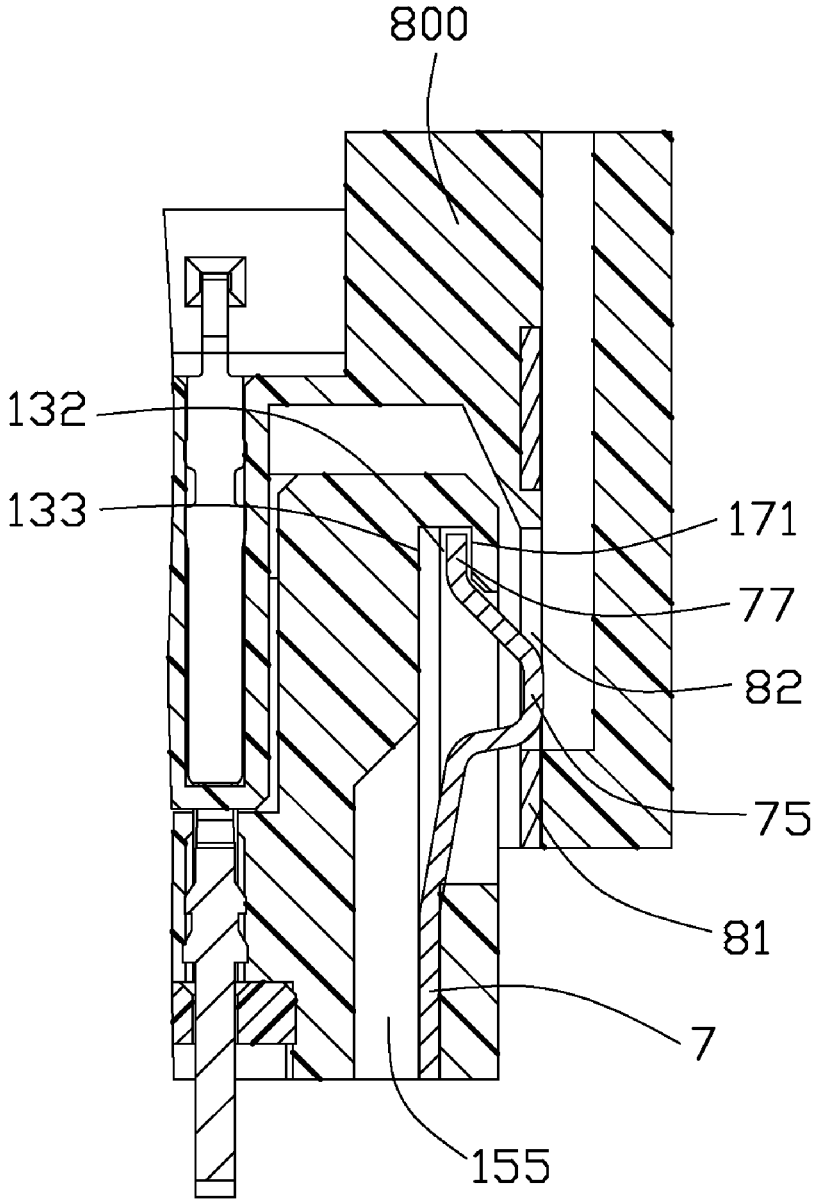
FIG. 7 is a partially cross-sectional view of the electrical connector and the mating connector at a locked position.

Referring to FIG. 7, when the mating connector 800 is completely inserted into the electrical connector 100, the engaging portion 75 slides across the conductive pad 81 and is plunged into the concave portion 82 of the mating connector 800. The resilient portion 73, the engaging portion 75 and the resisting portion 77 returns to the initial locked position.

A sufficient resilient force provided by the metal latch 7 has been exerted onto the mating connector. The engagement between the mating connector and the electrical connector 100 is reliable due to the resiliently movement of the metal latches 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for mating with a mating connector along a mating direction, comprising:

an insulative housing defining a front face, a pair of side walls, a pair of receiving spaces defined between the pair of side walls, and a partition wall disposed between the pair of receiving spaces, each side wall defining an opening;

a plurality of terminals received in the receiving spaces;

a pair of latches each mounted in the opening and formed with an engaging portion, said latch resiliently yielding in the opening along a moving direction perpendicular to the mating direction to permit the engaging portion to be moveable between a locked position and an unlocked position;

wherein said engaging portion of the latch projects outwardly from the opening along the moving direction;

wherein said side wall defines therein a recess communicating with the opening, and wherein each latch has a resisting portion formed at a free end of the engaging portion and moveably received in the recess;

wherein said insulative housing has a slot communicating with the opening and opposite to the recess, and wherein each latch comprises a fixing portion secured in the slot and a resilient portion formed between the fixing portion and the engaging portion;

wherein said insulative housing has a rear face opposite to the front face, and wherein said rear face defines therein a groove communicating with the opening, the resisting portion, the engaging portion and the resilient portion of the latch inserted into the opening through the groove.

2. The electrical connector assembly as claimed in claim 1, wherein said groove is disposed adjacent to the slot and communicating with the slot, said slot having a height corresponding to the fixing portion and greater than that of the groove.

3. The electrical connector assembly as claimed in claim 1, wherein said latch is made from metal material.

4. The electrical connector assembly as claimed in claim 1, the electrical connector is a Serial Advanced Technology Attachment connector.

5. The electrical connector assembly as claimed in claim 1, wherein said side wall has a bearing face facing toward the recess, said resisting portion of the latch resisting against the bearing face at the locked position and moving away from the bearing face at the unlocked position.

6. The electrical connector assemblt as claimed in claim 5, wherein said engaging portion of the latch contacts with a conductive pad formed on the mating connector at the unlocked position, and plunged in a concave portion defined in the mating connector at the locked position.

7. The electrical connector assembly as claimed in claim 1, wherein said terminals comprise a plurality of first terminals and a plurality of second terminals, and wherein said pair of receiving spaces comprise a first receiving space defining a plurality of first passageways for receiving the first terminals and a second receiving space defining a plurality of second passageways for receiving that second terminals.

8. The electrical connector assembly as claimed in claim 7, further comprising a carrier mounted on the insulative housing, said carrier defining a plurality passageways for fixing the first terminals and the second terminals.

9. The electrical connector assembly as claimed in claim 8, wherein said carrier has a plurality of blocks formed below corresponding terminal recesses for supporting the first terminals and the second terminals.

10. An electrical connector assembly comprising:

a first connector including:

a first elongated insulative housing extending along a longitudinal direction and defining a first mating port;

a plurality of first contacts disposed in the first housing with first contacting sections exposed in the first mating port;

a first deflectable metal latch forwardly assembled to an end of the first housing and including an locking portion extending beyond a corresponding first end wall of the housing; and a second connector including:

a second elongated insulative housing extending along the longitudinal direction and defining a second mating port;

a plurality of second contacts disposed in the second housing with second contacting sections exposed in the second mating port;

a second stationary metal latch assembled around an end of the second housing and including a locking opening to receive said locking portion; wherein said first housing defines a groove extends forwardly from a rear face of the first housing and located essentially transversely behind the first deflectable metal latch for facilitating assembling said first metal latch to the first housing, and said second housing defines a cavity located essentially transversely behind the locking opening of the second stationary metal latch wherein said first housing further defines an opening in the first end wall to allow said locking portion to outwardly extend therethrough under condition that the opening and the groove are essentially offset from each other in a front-to-back direction, which is perpendicular to the longitudinal direction, with portions overlapped with each other only around a middle portion of the housing in said front-to-back direction.

11. The electrical connector assembly as claimed in claim 10, wherein said first metal latch is made from sheet metal, and a thickness direction of said first metal latch is constantly perpendicular to a height direction which is perpendicular to both said longitudinal direction and said front-to-back direction.

12. The electrical connector assembly as claimed in claim 10, wherein said opening communicates with an exterior only along the longitudinal direction, not said front-to-back direction, while said groove communicates with the exterior essentially along said front-to-back direction.

13. An electrical connector comprising:

an insulative housing extending along a longitudinal direction and defining a mating port;

a plurality of contacts disposed in the housing with contacting sections exposed in the mating port;

said housing defining a latch mounting section at one end with an opening extending through a corresponding end wall of the housing under condition that said opening communicates with an exterior only along said longitudinal direction;

a groove formed in the latch mounting section beside the opening in said longitudinal direction under condition that said groove communicates with the exterior only in a front-to-back direction perpendicular to said longitudinal direction; and a metallic latch forwardly assembled to the latch mounting section via said groove to have thereof a locking portion protruding through said opening and beyond the end wall in said longitudinal direction;

wherein said opening and said groove are overlapped with each other around a middle portion of the housing in said front-to-back direction.

14. The electrical connector as claimed in claim 13, wherein said latch includes a fixing portion which is essentially located between the opening and the groove in said longitudinal direction.

* * * * *